US008544200B2

(12) United States Patent
Burns, III

(10) Patent No.: US 8,544,200 B2
(45) **Date of Patent: *Oct. 1, 2013**

(54) TRIGGER GUARD FOR LOADING AND UNLOADING A WEAPON

(71) Applicant: Marksman Shepherd LLC, Glen Mills, PA (US)

(72) Inventor: Michael L. Burns, III, Glen Mills, PA (US)

(73) Assignee: Marksman Shepherd LLC, Glen Mills, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/705,296

(22) Filed: Dec. 5, 2012

(65) Prior Publication Data

US 2013/0104437 A1 May 2, 2013

Related U.S. Application Data

(63) Continuation of application No. 12/959,583, filed on Dec. 3, 2010, now Pat. No. 8,347,539.

(51) Int. Cl.
*F41A 17/46* (2006.01)

(52) U.S. Cl.
USPC ..... 42/70.06; 42/70.07; 42/70.11

(58) Field of Classification Search
USPC ..... 42/70.01, 70.06, 70.07, 70.11, 96
See application file for complete search history.

(56) References Cited

U.S. PATENT DOCUMENTS

| | | | | |
|---|---|---|---|---|
| 1,513,267 | A | | 10/1924 | Parks |
| 2,364,340 | A | | 12/1944 | Boog, Jr. |
| 2,932,334 | A | | 4/1960 | Steen |
| 4,030,221 | A | | 6/1977 | Doobenen et al. |
| 4,084,341 | A | | 4/1978 | Cervantes |
| 4,392,318 | A | | 7/1983 | Daniels |
| 4,395,837 | A | | 8/1983 | Durnal |
| 4,509,281 | A | | 4/1985 | Drelling et al. |
| 4,627,185 | A | * | 12/1986 | Rohm ..... 42/66 |
| 4,689,908 | A | | 9/1987 | McClellan |
| 4,713,889 | A | * | 12/1987 | Santiago ..... 42/132 |
| 4,912,867 | A | | 4/1990 | Dukes, Jr. |
| 4,916,842 | A | * | 4/1990 | Hardy ..... 42/70.07 |
| 5,012,605 | A | * | 5/1991 | Nishioka ..... 42/70.07 |
| 5,033,218 | A | | 7/1991 | Nelson |
| 5,054,222 | A | * | 10/1991 | Hardy ..... 42/70.07 |
| 5,138,786 | A | | 8/1992 | Fischer |
| 5,191,158 | A | | 3/1993 | Fuller et al. |

(Continued)

OTHER PUBLICATIONS http://www.youtube.com/watch?v=mww-DQBbtfc (Video)—Upload date: Jan. 3, 2008.

(Continued)

*Primary Examiner* — Michael David
(74) *Attorney, Agent, or Firm* — DLA Piper LLP (US)

(57) ABSTRACT

A weapon safety apparatus comprising a sleeve comprising a cavity portion open to receive a trigger portion of a weapon and free of any structures that impede movement of the trigger. The sleeve further comprises a body portion comprising at least one closed portion preventing access to a trigger of the weapon. The sleeve is shaped to provide access to all loading or unloading components of the weapon. The cavity portion of the sleeve may be further open to receive a handle of the weapon. A method for loading and unloading a weapon using the above weapon safety apparatuses is also provided.

20 Claims, 7 Drawing Sheets

(56) References Cited

U.S. PATENT DOCUMENTS

| | | | | |
|---|---|---|---|---|
| 5,309,661 | A | 5/1994 | Fuller et al. | |
| 5,313,733 | A | 5/1994 | Meade | |
| 5,371,965 | A | 12/1994 | Nelson | |
| 5,450,684 | A | 9/1995 | Harris | |
| 5,515,633 | A | 5/1996 | Harris | |
| 5,561,935 | A | 10/1996 | McCarthy et al. | |
| 5,647,158 | A * | 7/1997 | Eskelinen et al. | 42/70.07 |
| 5,768,816 | A | 6/1998 | Ressias | |
| 5,768,819 | A | 6/1998 | Neal | |
| 5,778,586 | A * | 7/1998 | Carlson | 42/70.07 |
| 5,960,575 | A | 10/1999 | Chiovitt et al. | |
| 6,128,847 | A | 10/2000 | Langner | |
| 6,230,946 | B1 | 5/2001 | Vor Keller et al. | |
| 6,256,922 | B1 * | 7/2001 | Jones et al. | 42/96 |
| 6,272,784 | B1 | 8/2001 | Ringers | |
| 6,276,086 | B1 | 8/2001 | Keaton | |
| 6,349,496 | B1 * | 2/2002 | Neely | 42/70.11 |
| 6,389,727 | B2 * | 5/2002 | Schnell | 42/70.07 |
| 6,415,540 | B1 | 7/2002 | Ringers | |
| 6,438,885 | B1 * | 8/2002 | Murray et al. | 42/70.07 |
| 6,457,272 | B1 * | 10/2002 | Weinraub | 42/70.07 |
| 6,550,175 | B2 * | 4/2003 | Parker | 42/70.07 |
| 6,799,392 | B2 | 10/2004 | Milec et al. | |
| 7,216,449 | B2 | 5/2007 | Riebling et al. | |
| 7,543,404 | B2 | 6/2009 | Kovalchuk et al. | |
| 2002/0178634 | A1 * | 12/2002 | Weinraub | 42/70.07 |
| 2011/0010978 | A1 * | 1/2011 | Hooks | 42/69.01 |
| 2011/0047849 | A1 * | 3/2011 | Brenner | 42/70.07 |
| 2012/0137559 | A1 * | 6/2012 | Burns, III | 42/70.06 |

OTHER PUBLICATIONS http://www.warriortalk.com/showthread.php?56486-Kydex-Trigger-Guard-Holster; Blog entries. Jul. 11, 2009 to Aug. 10, 2009.

* cited by examiner

TRIGGER GUARD FOR LOADING AND UNLOADING A WEAPON

CROSS-REFERENCE TO RELATED APPLICATION

The present application is a continuation of U.S. patent application Ser. No. 12/959,583 filed Dec. 3, 2010, the subject matter of which is incorporated herein by reference.

TECHNICAL FIELD

The present disclosure relates to weapon safety. In particular, the present disclosure relates to an apparatus and method for safely loading and unloading weapons.

BACKGROUND

Every year, accidental discharges of weapons cause injury and death. Although many accidental discharges occur during loading and unloading ammunition, the safety designs aimed at preventing accidental discharges have focused on immobilizing triggers without regard for providing access to the elements of a weapon for loading or unloading. Because these designs focus on preventing accidental discharges by immobilizing triggers for a non-temporary duration of time and do not provide for access to loading and unloading elements, the designs are not suited for use when a user desires to quickly load or unload a weapon. The only current solution to accidental discharges while loading and unloading a weapon is training. Even with substantial training, the threat of accidental discharge remains for numerous reasons including user error. The present invention is designed to overcome the limitations of the prior art and save lives.

One example of the prior art is illustrated and described in U.S. Pat. No. 6,276,086 to Keaton, entitled MAGNETIC TRIGGER COVER filed on Aug. 21, 2001 ("Keaton"). Keaton discloses a trigger cover having two parts that connect over a trigger to immobilize the trigger. The Keaton device does not provide for quick application because the magnet must be lined up to engage and lock the trigger. It is also an aspect of the invention to provide a child proof lock, which does not allow for easy removal. The Keaton device is also not shaped to allow for loading and unloading as it, for example, prevents the revolver cylinder from opening.

Another example of the prior art is illustrated and described in U.S. Pat. No. 5,960,575 to Chiovitt et al., entitled TRIGGER GUARD LOCK FOR FIREARM filed on Oct. 5, 1999 ("Chiovite"). Chiovitt discloses a trigger guard having a plurality of apertures, fasteners and washers that have to be lined up to connect and obstruct the trigger from moving. Like the trigger cover in Keaton, the Chiovitt trigger guard does not provide for quick application because the apertures, fasteners and washers have to be lined up to lock the trigger. Moreover, an aim of Chiovitt is to provide unauthorized access by requiring household tools to remove the trigger guard, which does not provide for quick application. Chiovitt also does not disclose a shape that allows the weapon to be loaded and unloaded. In fact, Chiovitt is specifically aimed at preventing a situation where a gun customer can ask to inspect a gun, load it and rob a gun store.

A further example of the prior art is illustrated and described in U.S. Pat. No. 5,450,684 to Harris, entitled TRIGGER SHIELD flied on Aug. 12, 1994 ("Harris"), Harris discloses a device that covers and locks onto the trigger portion of a gun using numerous plates, interconnecting means and locking means. Like the trigger cover in Keaton and the trigger guard in Chiovitt, the Harris trigger shield does not provide for quick application because many parts must be connected to prevent access to triggers, it is also an aim of Harris to provide a child proof device, that is difficult to remove. Moreover, Harris does not disclose a shape that allows the weapon to be loaded and unloaded.

Another example of the prior art is illustrated and described in U.S. Pat. No. 4,912,867 to Dukes, Jr., entitled FIREARM SAFETY APPARATUS AND METHOD OF USING SAME filed on Aug. 31, 1989 ("Dukes"). Dukes discloses a flexible sleeve shaped to accept a firearm and its trigger assembly. The flexible sleeve includes a lever to lock the hammer of a gun thereby preventing discharge. The Dukes device is not shaped to allow for loading and unloading as it, for example, prevents the revolver cylinder from opening. The Dukes device also locks the hammer of a gun, which extends the duration needed to apply the device.

Another example of the prior art is illustrated and described in U.S. Pat. No. 5,768,819 to Neal, entitled GUN GUARD filed on Mar. 14, 1997 ("Neal"). Neal discloses a clam-shell design for looking a gun, which covers a substantial portion of the gun. Because Neal enclosed almost all of the gun, the gun cannot be loaded or unloaded while using the device disclosed in Neal.

Another example of safety devices in the prior art include locking mechanisms that are integral to the weapon. These devices are limited because they are only applicable to the weapon in which they are installed. They also require a gunsmith to install the device. Moreover, adding features to weapons adds to the weight of weapons and could cause the weapons to malfunction.

SUMMARY

In view of the problems with current weapon safety devices and methods, there exists a need to provide an apparatus and method for quickly, easily and temporarily preventing access to a trigger so that a user may safely load and unload a weapon without significant delay.

Thus, one aspect of the present disclosure is to provide a weapon safely apparatus and method for easily preventing access to a trigger so that a user would not be significantly delayed when loading or unloading a weapon.

In one example, a sleeve is provided that simply slides over the trigger portion of a gun and is shaped to provide access to loading and unloading components of the weapon. In another example, a sleeve is provided that slides over the trigger portion and handle portion of a gun and is shaped to provide access to loading and unloading components of the weapon. Once either sleeve is properly placed on the weapon, a user can load or unload the weapon without having access to the trigger.

Further scope of applicability of the present disclosure will become apparent from the detailed description given hereinafter and the accompanying drawings which are given by way of illustration only, and thus not to be considered limiting.

DETAILED DESCRIPTION

The present disclosure is based on the idea that by providing an apparatus that quickly and easily prevents access to a trigger of a weapon, weapon loading and unloading will be safer. Also, gun users will be more likely to use the idea because it would not significantly delay the loading or unloading process.

A weapon safety apparatus, according to a first embodiment, in its most general form, comprises a sleeve comprising a cavity portion open to receive a trigger portion of a weapon that is free of any structures that impede movement of the trigger. The sleeve also comprises a body portion comprising at least one closed portion preventing access to a trigger of the weapon. The sleeve is shaped to provide access to all loading or unloading components of the weapon.

In a second embodiment, the cavity portion of the of the sleeve is further open to receive a handle of the weapon. This embodiment may be needed depending on the shape of the weapon and may also provide more stability when the weapon safety apparatus is placed on the weapon depending on the user and the shape of the weapon.

The body portion of the sleeve may be one solid piece. Alternatively, the body portion further comprises a left side portion, a right side portion, and a connection between the left side portion and the right side portion. Making the body portion from more than on piece may be necessary for placement on some weapon designs. It also may be preferable to some users.

A method for loading and unloading a weapon using the above weapon safety apparatuses is also provided. The method comprises providing one of the above weapon safety apparatuses; placing the weapon safety apparatus on the weapon thereby preventing access to the trigger of the weapon; and changing the amount of ammunition in the weapon.

Figure 1:
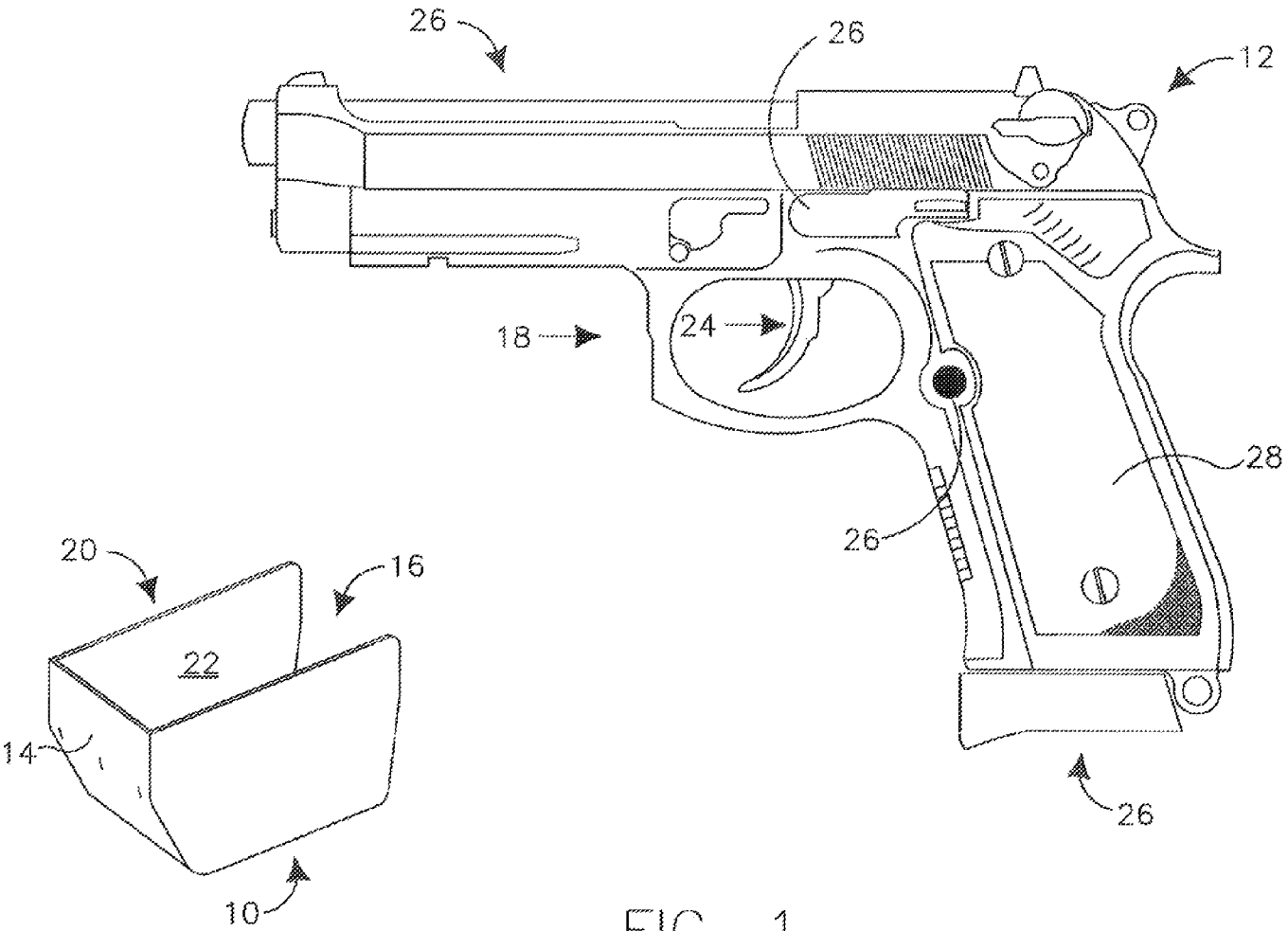
FIG. 1 shows a first embodiment of a weapon safety apparatus and a weapon.
Figure 2:
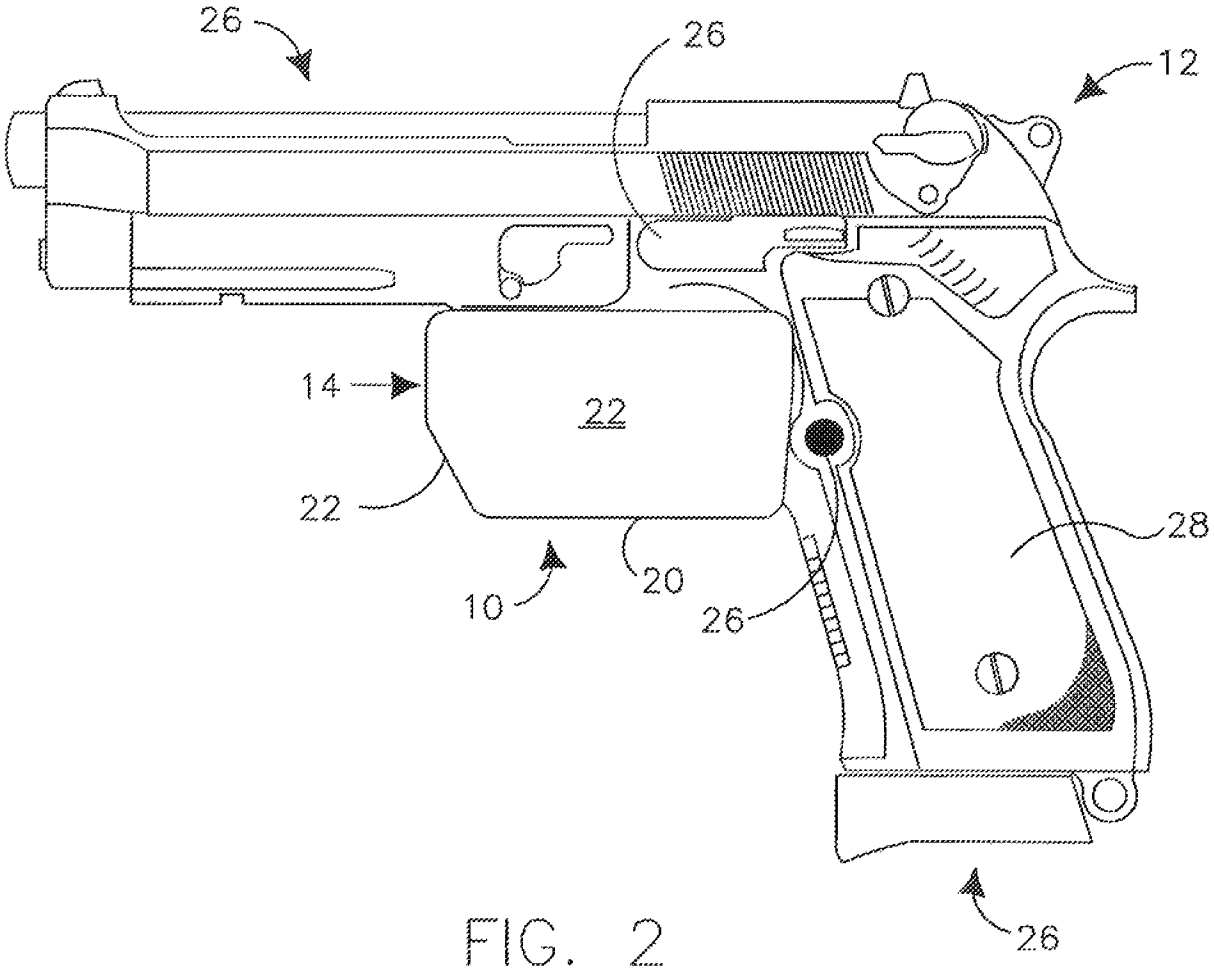
FIG. 2 shows the first embodiment of the weapon safety apparatus of FIG. 1 placed on the weapon of FIG. 1.

Turning now to FIGS. 1 and 2, one embodiment of a weapon safety apparatus 10 and a weapon 12 is shown. Although the weapon 12 is shown as an auto pistol, the weapon 12 can be any device having a trigger and the capability to be loaded or unloaded, such as, for example, crossbows and other types of guns including revolvers, BB guns, grenade launchers and shot guns.

The weapon safety apparatus 10 comprises a sleeve 14 comprising a cavity portion 16 open to receive a trigger portion 18 of a weapon 12. The cavity portion 16 is also free of any structures that impede movement of the trigger. The sleeve 14 is not shaped to immobilize the trigger 24 because the weapon safety apparatus 10 is not a trigger lock. As noted above, the weapon safety apparatus 10 is used to temporarily prevent access to the trigger 24 for safely loading and unloading the weapon 12.

The cavity portion 16 can take many shapes, but only needs to be constructed to receive or fit over a trigger portion 18 of a weapon 12. As such, the cavity portion 16 may be smaller than the trigger portion 18 if the sleeve 14 is flexible to augment the cavity portion 16 to allow the sleeve 14 to clamp onto the trigger portion 18.

The sleeve 14 further comprises a body portion 20 comprising at least one closed portion 22 preventing access to a trigger 24 of the weapon 12. The at least one closed portion 22 is provided to prevent a user's finger from pulling the trigger 24 while loading and unloading the weapon. The at least one closed portion 22 may take a multitude of shapes and only needs to cover enough of the trigger 24 so that a user's finger cannot access the trigger 24. For example, the closed portion can be striped so that the trigger 24 can be seen but not accessed.

The sleeve 14 is shaped to provide access to all loading or unloading components 26 of the weapon 12. As noted above, the weapon safety apparatus 10 is not limited to auto pistols and the sleeve 14 may take numerous shapes to provide access to all loading or unloading components 26 of various types of devices that can be loaded or unloaded. The sleeve 14 may also define a send-enclosed area that is free of any structures that impede movement of the trigger. As such, the trigger 24 may be at least partially visible.

The sleeve 14 may further comprise one or more openings providing access to one ore more loading or unloading components of the weapon. For example, the sleeve 14 may be one solid piece with openings specifically sized to allow access to loading or unloading portions. The one or more openings may also include coverings such as caps to prevent access to certain loading or unloading components while others are exposed. As such, a step by step process to unload or load a weapon may be employed such that only one step is possible at a time by, for example, numbering the coverings of the one or more openings.

Figure 3:
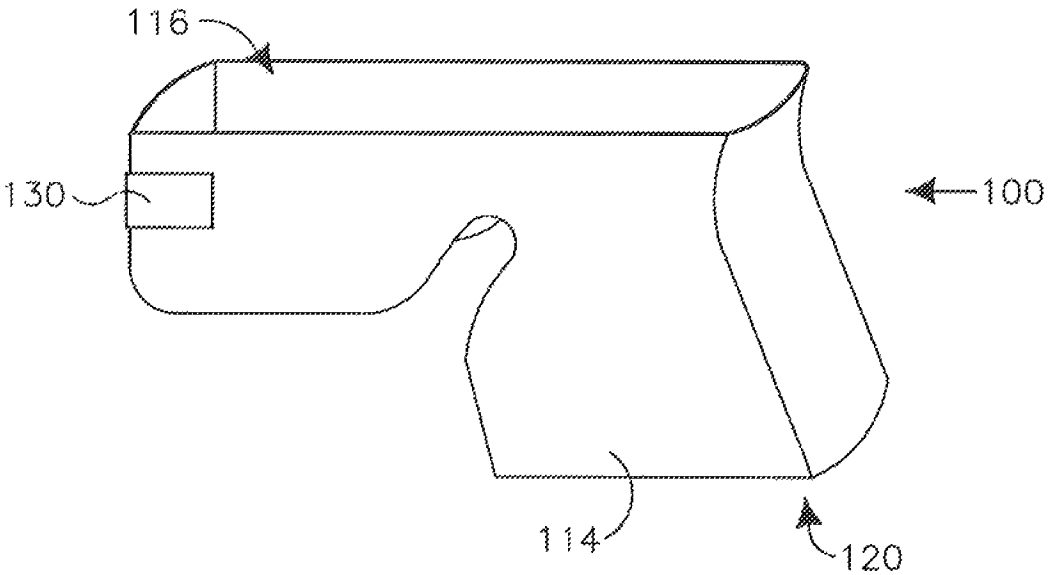
FIG. 3 shows a second embodiment of a weapon safety apparatus.
Figure 4:
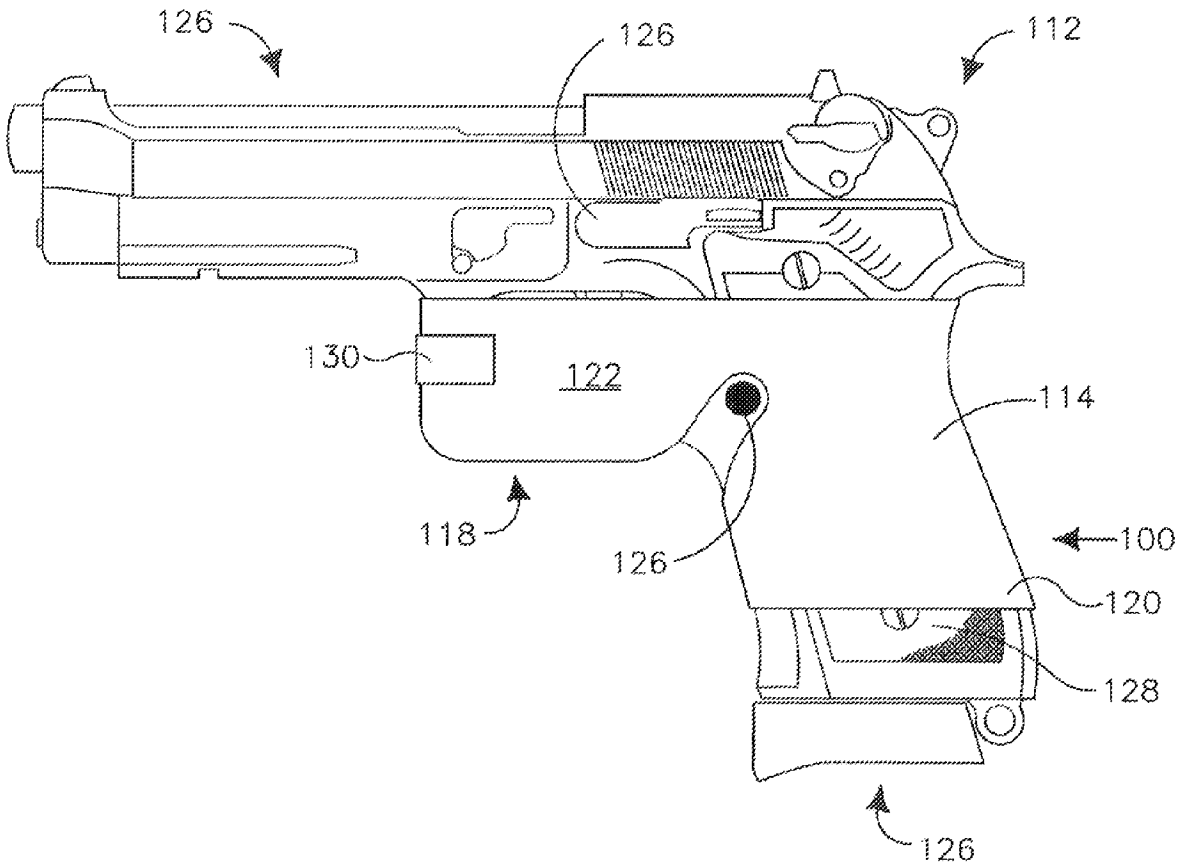
FIG. 4 shows the second embodiment of the weapon safety apparatus of FIG. 3 placed on a weapon.

Moving now to FIGS. 3 and 4, another embodiment of the weapon safety apparatus 100 is shown. Like the weapon safety apparatus 10 shown in FIGS. 1 and 2, the weapon safety apparatus 100 shown, in FIGS. 3 and 4 comprise a sleeve 114 comprising a cavity portion 116 open to receive a trigger portion 118 of a weapon 112. The sleeve 114 further comprises a body portion 120 comprising at least one closed portion 122 preventing access to a trigger of the weapon 112. The sleeve 114 is shaped to provide access to all loading or unloading components of the weapon 126. The sleeve is not shaped to immobilize the trigger.

Unlike the embodiment shown in FIGS. 1 and 2, the cavity portion 116 of the weapon safety apparatus 100 shown in FIGS. 2 and 3 is further open to receive a handle 128 of a weapon 112. This embodiment may be preferable because it may provide a more secure connection with the weapon 112. The cavity portion 116 in this embodiment may take numerous shapes to accommodate the handles of other weapons while allowing access to loading or unloading components of a weapon. For example, if a loading or unloading components are located in the middle of a handle, the sleeve may include an access hatch or a void to allow a user access to the component.

Figure 6:
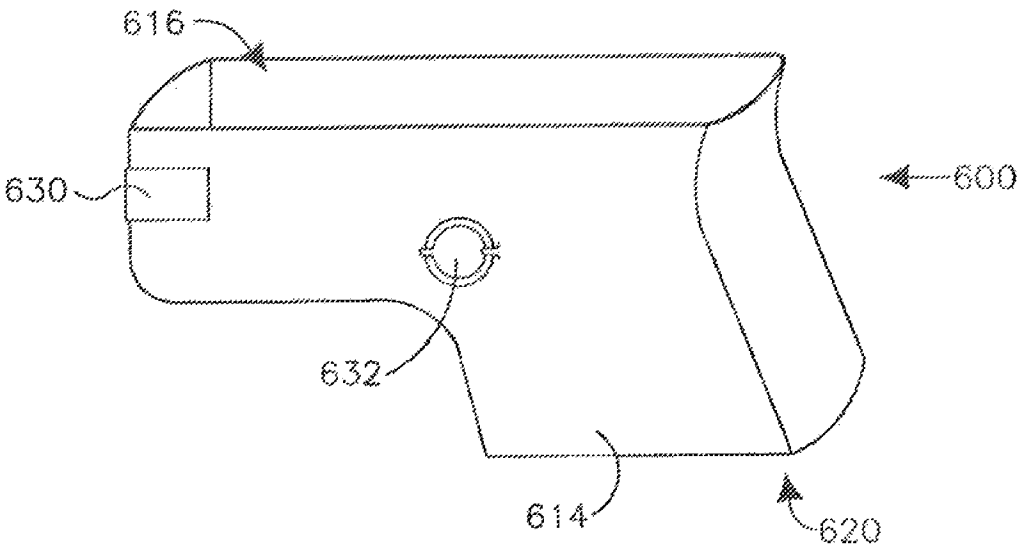
FIG. 6 shows a third embodiment of a weapon safety apparatus.
Figure 7:
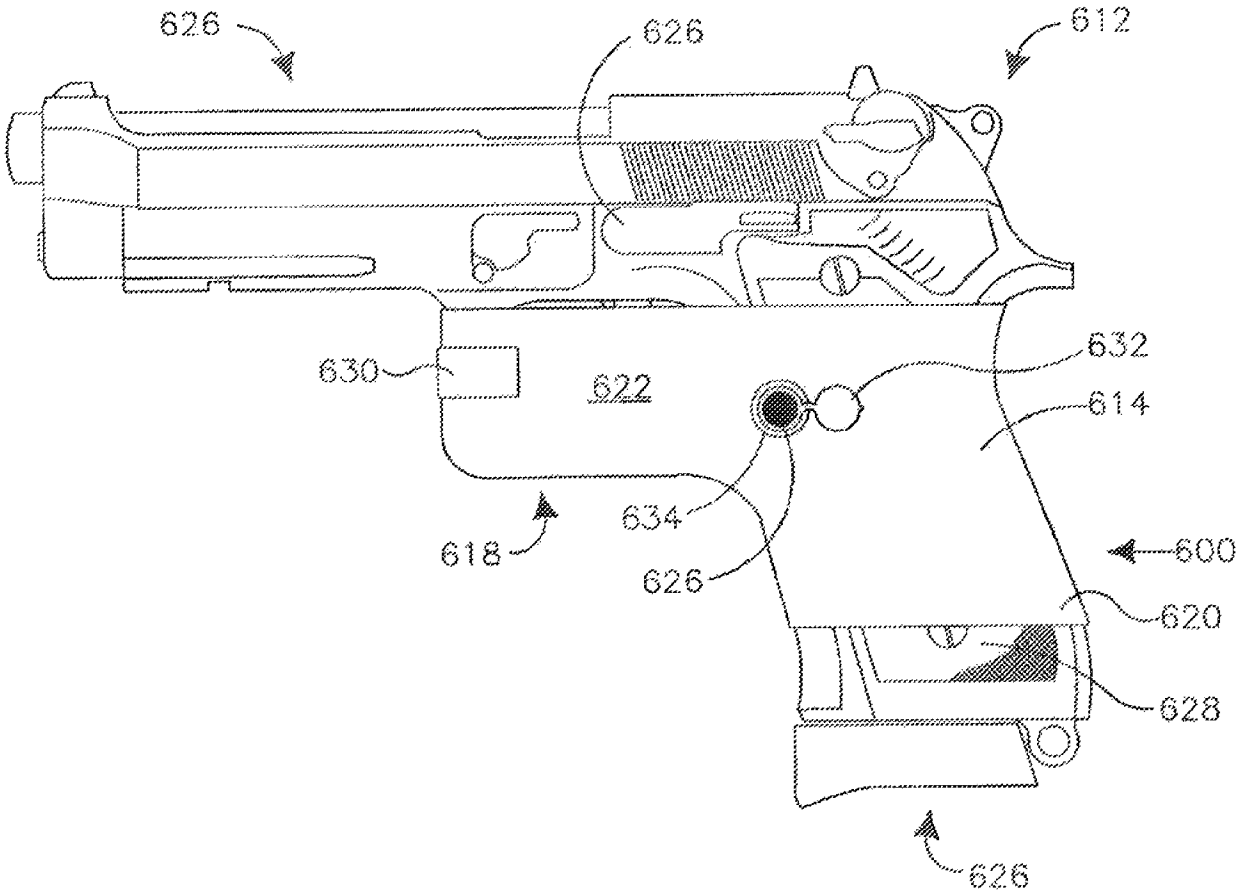
FIG. 7 shows the third embodiment of the weapon safety apparatus of FIG. 6 placed on a weapon.

Moving now to FIGS. 6 and 7, another embodiment of the weapon safety apparatus 600 is shown. Like the weapon safety apparatus 10 shown in FIGS. 1 and 2, the weapon safety apparatus 600 shown in FIGS. 6 and 7 comprise a sleeve 614 comprising a cavity portion 616 open to receive a trigger portion 618 of a weapon 612. The sleeve 614 further comprises a body portion 620 comprising at least one closed portion 622 preventing access to a trigger 636 of the weapon 612. The sleeve 614 is shaped to provide access to all loading or unloading components of the weapon 626. Unlike the embodiment shown in FIGS. 1-4, the sleeve 614 further comprises an opening 634 providing access to the loading or unloading components of the weapon. The sleeve farther comprises a covering 632 for the opening. The sleeve is not shaped to immobilize the trigger 636.

As shown in FIGS. 1-4, 6 and 7, the body portion 20, 120, 620 is one piece. However, the body portion 20, 120, 620 may further comprise more than one piece. For example, the body portion 20, 120, 620 may a comprise a left side portion, a right side portion, and a connection 130, 630 between the left side portion and the right side portion. This may be preferred by some users. It also may be preferable for the embodiment shown in FIGS. 3, 4, 6 and 7 to allow the handle to be more easily covered while providing access to loading and unloading components.

If more than one piece is used for the body portion 20, 120, 620, the connection 130, 630 may be any connection suitable to connect the two pieces. The connection 130, 630 may be formed from the body portion 20, 120, 620 itself or the connection 130, 630 may be another piece. For example, the connection 130, 630 may be an adapter, an adhesive, a bolt, a buckle, a button, a clamp, a catch, a clasp, a coupling, a dowel, a fastener, a fabric hook-and-loop fastener, a joint, a junction, a latch, a lock, a link, a magnet, a peg, a pin, a rivet, a rod, a snap, a spring, a screw, a sliding bar, a spike, a stake, a staple, a stud, or a tie.

The weapon safety apparatus 10, 100, 610 may be any material suitable for preventing access to a trigger portion 18, 118, 618. For example, the sleeve 14, 114, 614 may be rubber, plastic, metal, or a polymer.

The weapon safety apparatus 10, 100, 610 sleeve 14, 114, 614 may be further shaped according to a contour of a human hand to facilitate gripping. For example, the sleeve 14, 114, 614 may have ergonomic undulations or grooves to facilitate gripping. As another example, in the embodiment shown in FIGS. 1 and 2, the sleeve 14 may include features to make it easier for a user to place and remove the weapon safety apparatus 10 from the weapon 12. As a further example, in the embodiment shown in FIGS. 3 and 4, the sleeve 114 may include features to make it easier for a user to hold the weapon safety apparatus 100 and weapon 112 while loading and unloading the weapon 112.

The weapon safety apparatus 10, 100, 600 sleeve 14, 114, 614 may further comprise interior gripping material. This material would be added to the exterior of the sleeve to improve the ability of the weapon safety apparatus 10, 100, 600 to grip the gun. For example, if the weapon safety apparatus 10, 100, 600 is wooden, rubber pads may be added to help grip the weapon 12, 112, 612.

The weapon safety apparatus 10, 100, 600 sleeve 14, 114, 614 may further comprise exterior gripping material. This material would be added to the exterior of the sleeve to improve the ability of a user to grip the weapon safety apparatus 10, 100, 600. For example, if the weapon safety apparatus 10, 100, 600 is wooden, rubber pads may be added to help grip the weapon safety apparatus 10, 100.

The weapon safety apparatus 10, 100, 600 sleeve 14, 114, 614 may further comprise interior weapon protection material. This material would be added to protect the weapon 12, 112, 612 from scratching or other imperfections occurring when the weapon safety apparatus 10, 100, 600 is used. For example, the sleeve 14, 114, 614 interior may be lined with foam padding.

Figure 5:
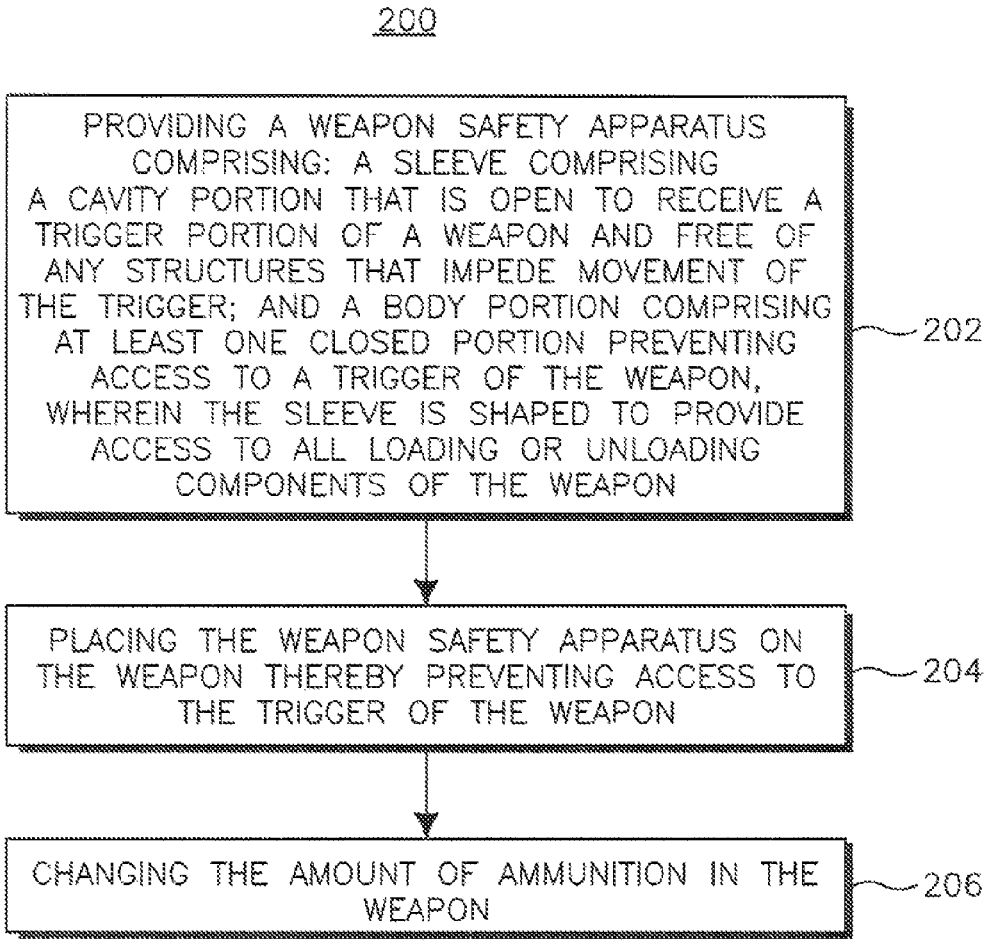
FIG. 5 shows a flow diagram for a method for loading and unloading a weapon.

Referring now to FIG. 5, a flow diagram is shown illustrating a method 200 for loading and unloading a weapon. The method begins at step 202, wherein a weapon safety apparatus is provided comprising a sleeve comprising a cavity portion that is open to receive a trigger portion of a weapon and free of any structures that impede movement of the trigger; and a body portion comprising at least one closed portion preventing access to a trigger of the weapon, wherein the sleeve is shaped to provide access to all loading or unloading components of the weapon. Step 202 essentially provides the weapon safety apparatus 10, 100, 600 described above with all of its possible features.

The next step 204 is placing the weapon safety apparatus on the weapon thereby preventing access to the trigger of the weapon. This step requires a user to place the weapon safety apparatus 10, 100, 600 on the weapon 12, 112, 612. Depending on how the weapon safety apparatus 10, 100, 600 is configured this step 204 may change dramatically. For example, the weapon safety apparatus 10 in shown in FIGS. 1 and 2 may be a clip-type whereby the body portion 20 would have to be stretched to allow the cavity portion 16 to be expanded to receive the trigger portion 18 of the weapon 12 before it is released and clamps onto the trigger portion 18 of the weapon 12. As another example, the weapon safety apparatus 100 in shown in FIGS. 3 and 4 may be slid onto the weapon 112 and made out of a flexible material whereby a users grip keeps the weapon safety apparatus 100 on the weapon 112 until the user slides the weapon safety apparatus 100 off the weapon 112.

The next step 206 is changing the amount of ammunition in the weapon. This step 206 may be accomplished many ways depending on the type of weapon 12 involved. For example, if the weapon 12 is a revolver, unlatch the cylinder release latch; move the cylinder away from the barrel; add or remove bullets from the cylinder; and close the cylinder.

As another example, if the weapon is similar to the weapon shown in FIG. 1, the magazine, which is located inside the handle, is ejected by pressing the magazine release located on the gun handle. The amount of ammunition, in the magazine can then be changed. The barrel slide must also be opened by pressing the slide release located above the trigger portion. The amount of ammunition in the barrel portion or slide of the weapon can then be changed.

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A weapon safety apparatus, comprising:

a sleeve comprising:

a cavity portion that is open and configured to receive a trigger portion and a handle portion of a weapon and free of any structures that impede movement of a trigger; and a body portion comprising at least one closed portion preventing access to the trigger, wherein the sleeve is shaped to provide access to all loading or unloading components of the weapon; and wherein the sleeve is attached to the weapon solely by frictional force between the sleeve and the weapon.

2. The weapon safety apparatus of claim 1, wherein the sleeve further comprises one or more openings providing access to one or more loading or unloading components of the weapon.

3. The weapon safety apparatus of claim 2, wherein the sleeve further comprises one or more coverings for the one or more openings.

4. The weapon safety apparatus of claim 1, wherein the cavity portion is further open to receive a third portion of the weapon.

5. The weapon safety apparatus of claim 1, wherein the body portion further comprises a left side portion, a right side portion and a connection between the left side portion and the right side portion.

6. The weapon safety apparatus of claim 1, wherein the sleeve is free of a locking mechanism integral to the weapon.

7. The weapon safety apparatus of claim 1, wherein the sleeve is further shaped according to a contour of a human hand to facilitate gripping.

8. The weapon safety apparatus of claim 1, wherein the sleeve further comprises interior gripping material.

9. The method of claim 8, wherein the interior gripping material is selected from the group consisting of a textured pad, a magnet and a suction cup.

10. The weapon safety apparatus of claim 1, wherein the sleeve further comprises exterior gripping material.

11. A weapon safety apparatus, comprising:

a sleeve comprising:

a cavity portion that is open and configured to receive a trigger portion and a handle portion of a weapon and free of any structures that impede movement of a trigger; and a body portion comprising at least one closed portion preventing access to the trigger, wherein the sleeve is shaped to provide access to all loading or unloading components of the weapon; and wherein the sleeve is attached to the weapon solely by frictional force and compression force between the sleeve and the weapon.

12. The weapon safety apparatus of claim 11, wherein the sleeve further comprises one or more openings providing access to one or more loading or unloading components of the weapon.

13. The weapon safety apparatus of claim 12, wherein the sleeve further comprises one or more coverings for the one or more openings.

14. The weapon safety apparatus of claim 12, wherein the cavity portion is further open to receive a third portion of the weapon.

15. The weapon safety apparatus of claim 12, wherein the body portion further comprises a left side portion, a right side portion and a connection between the left side portion and the right side portion.

16. The weapon safety apparatus of claim 12, wherein the sleeve is free of a locking mechanism integral to the weapon.

17. The weapon safety apparatus of claim 12, wherein the sleeve is further shaped according to a contour of a human hand to facilitate gripping.

18. The weapon safety apparatus of claim 12, wherein the sleeve further comprises interior gripping material.

19. The method of claim 18, wherein the interior gripping material is selected from the group consisting of a textured pad, a magnet and a suction cup.

20. The weapon safety apparatus of claim 12, wherein the sleeve further comprises exterior gripping material.

* * * * *